US005417582A

United States Patent [19]

Tang

[11] Patent Number: 5,417,582

[45] Date of Patent: May 23, 1995

[54] CONNECTOR TERMINALS FOR USE IN COMPUTERS

[76] Inventor: Wen-Yun Tang, 16, Chung-Haw St., Kuei-San Hsian, Tau-Yuan Hsien, Taiwan, Prov. of China

[21] Appl. No.: 138,361

[22] Filed: Oct. 18, 1993

[51] Int. Cl.[6] ..... H01R 4/24

[52] U.S. Cl. ..... 439/400; 439/397; 439/398

[58] Field of Search ..... 439/395, 396, 397, 398, 439/399, 400, 401, 402, 407, 408

[56] References Cited

U.S. PATENT DOCUMENTS

| | | | |
|---|---|---|---|
| 3,227,991 | 1/1966 | Zdanis | 439/397 |
| 3,845,455 | 10/1974 | Shoemaker | 439/399 |
| 4,046,446 | 9/1977 | Reavis, Jr. | 439/398 X |
| 4,074,929 | 2/1978 | Krider | 439/400 X |
| 4,291,935 | 9/1981 | Badoz et al. | 439/399 |
| 4,722,699 | 2/1988 | Heng et al. | 439/402 X |
| 4,834,670 | 5/1989 | Rodondi et al. | 439/399 X |
| 5,022,868 | 6/1991 | Legrady | 439/399 |

FOREIGN PATENT DOCUMENTS

| | | | |
|---|---|---|---|
| 128649 | 12/1984 | European Pat. Off. | 439/398 |

*Primary Examiner*—William Briggs
*Attorney, Agent, or Firm*—Davis Hoxie Faithfull & Hapgood

[57] ABSTRACT

The present invention provides an improved structure for connector terminals for use in computers, directing primarily to terminals for serial and parallel connectors wherein one end of the terminal is a contacting section and the other end is a connecting section with an inserting section interposed therebetween for inserting a plastic base to be joined therein. The connecting section of the terminal is of a hollow rectangular shape in cross section, wherein one wall face is formed into a downwardly extending axial groove and a plurality of catching notches for catching the leads and the opposite wall face is provided with an axial slot by which a plurality of leads can be pressed in sequence into the axial groove and the axial slot such that one lead is received in one catching notch and the insulating layer of each of the leads is cut by the axial slot, enabling contact with the core of the lead, thus to obtain the effect of shared use, and to avoid the drawbacks in use with lead connection in the welding, clamping and pressing manner.

2 Claims, 11 Drawing Sheets

CONNECTOR TERMINALS FOR USE IN COMPUTERS

FIELD OF THE INVENTION

The present invention relates to structural improvements in connector terminals for use in computers and, in particular, to the contacting section of the terminal for connectors for receiving a plurality of leads pressed therein and for catching the insulating layer of the leads for direct contact with the core of the lead, which is suitable for use in the structure of serial and parallel connector terminals.

BACKGROUND OF THE INVENTION

With respect to signal transmission, there are serial computer connectors and according to the manner in which the leads are connected, there are computer connectors having welded, press and clamp connected leads. The above types are different one from another and each may have advantages and disadvantages.

Referring to FIGS. 1 and 2, there are shown the perspective view of a conventional welded terminal and the perspective view of the welded leads in the conventional welded female terminal, respectively. In the conventional welded terminal, one end is a contacting section and the other end is a connecting section with a catching section interposed therebetween for inserting a plastic base to be joined therein, the connecting section of the terminal being of semicircular shape in cross section, the exposed core at the lead end being inserted into the connecting section of the terminal and then welded to secure. However, welding tends to be environmentally hazardous and increases impedance, thus leading to poor conductivity.

Referring to FIGS. 3*a*, 3*b* and 4, there are shown the perspective view of a conventional clamp connected terminal and the perspective view of the conventional clamp connected terminal assembly, respectively. One end of the conventional clamp connected terminal is a contacting section and the other end is a connecting section with a catching section therebetween, the connecting section of the terminal being in a "U" shape, for the lead end and its core to be inserted therein and then clamped to secure and, finally, the terminal to be fitted into a plastic base. However, the leads have to be clamped and then each of the terminals can be assembled, thus leading to inefficient operation and increased cost.

Referring to FIG. 5 and 6, there are shown the perspective view of a conventional pressing connected terminal and the perspective view of a conventional pressing connected terminal assembly, respectively. One end of the conventional pressing connected terminal is a contacting section and the other end is a connecting section with a catching section therebetween. The connecting section of the terminal is formed into branched ends having cutting slots. The leads are pressed into respective cutting slots of the terminal by a pressing strip such that the insulating layer of the leads are cut, enabling the core to make contact with the terminal, thus to avoid the disadvantage of the welded terminals. However, in the pressing connected terminals, a pressing strip must be provided to prevent the leads from coming off and this type of terminals are suitable for use only in a one to one manner, that is, one lead in one terminal, such that application of the terminal is limited because that it is impossible for a plurality of leads to share a single terminal.

In view of the above disadvantages with conventional terminals having leads connected in the welding, pressing and clamping manners, improvements have been initiated directing to such disadvantages for a reasonable solution and, after numerous analyses and trials, obtains the structural improvement of connector terminals for use in computers of the present invention.

The object of the present invention is to provide an improved structure for use with terminals in serial and parallel connectors. The connecting end of the terminal can receive a plurality of leads to be pressed therein to secure and cut the insulating layer of the leads for direct contact of the lead core with the terminal. In addition to one lead mating with one terminal, a single terminal can be shared by a plurality of leads for broadened application, thus avoiding the problem of environmental hazards with welded terminals, and increasing signal impedance so as to meet the current international requirements.

DESCRIPTION OF THE FIGURES

To achieve the above object of the present invention, the technical means utilized, and the effects thereof will be described in detail by way of feasible embodiments given in conjunction with the accompanying drawings in which.

DETAILED DESCRIPTION OF THE INVENTION

Figure 1:
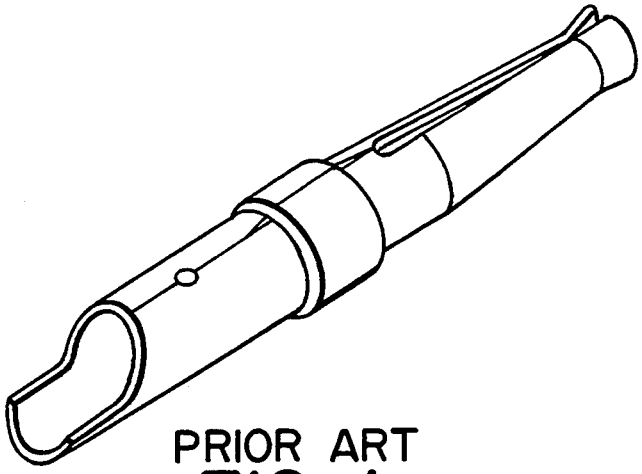
PRIOR ART FIG. 1
FIG. 1 is a perspective view of a conventional welded terminal.
Figure 2:
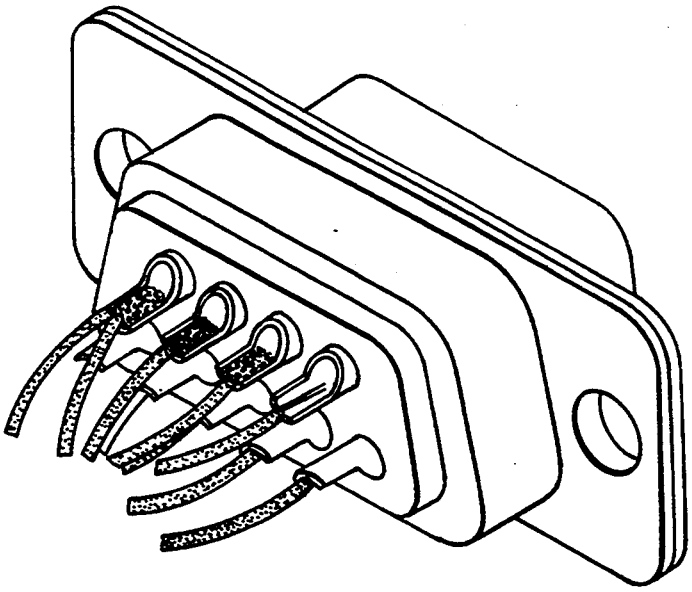
PRIOR ART FIG. 2
FIG. 2 is a perspective view of the welded leads in the conventional welded terminal.
Figure 3A:
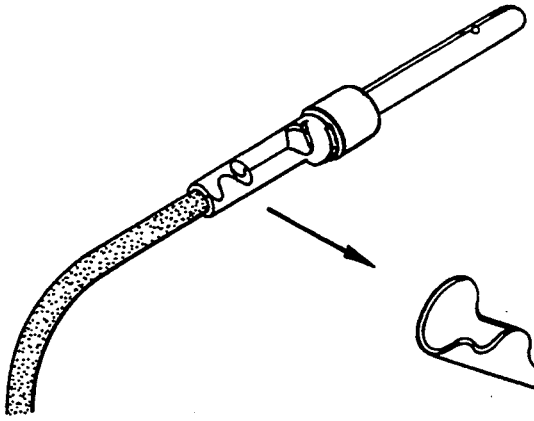
PRIOR ART FIG. 3A
FIG. 3*a* is a perspective view of a conventional clamp connected terminal.
Figure 3B:
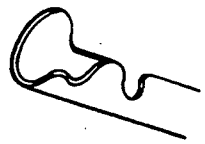
PRIOR ART FIG. 3B
FIG. 3*b* is an enlarged view of a portion of FIG. 3*a*.
Figure 4:
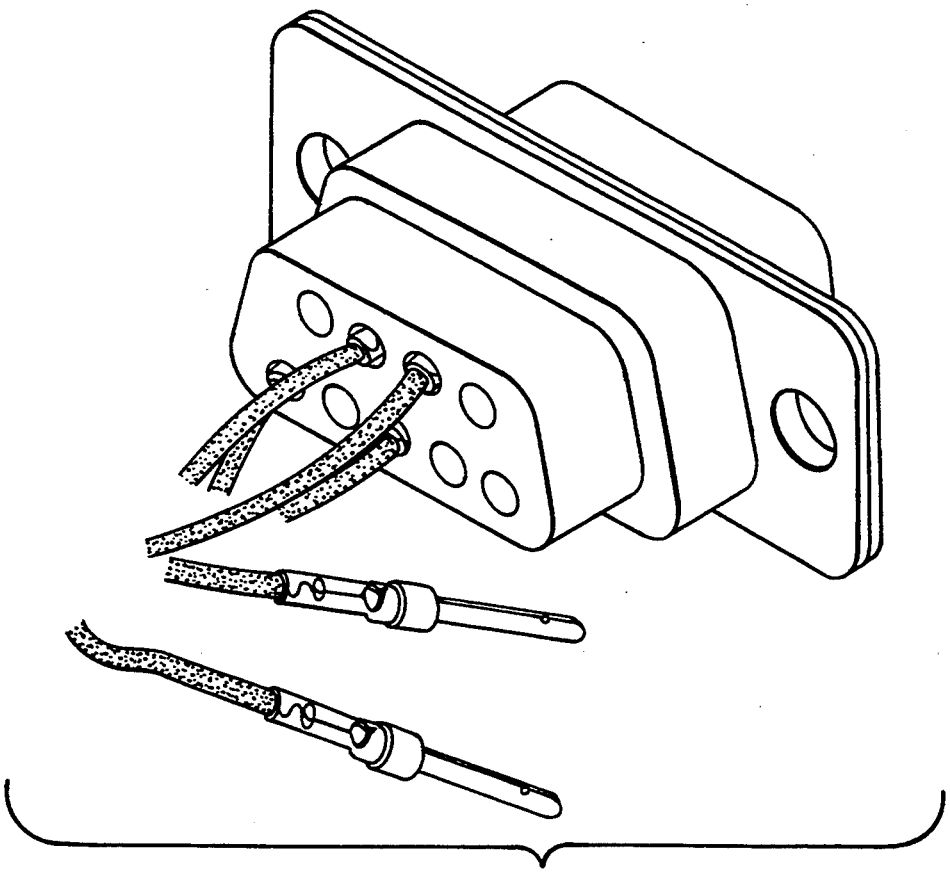
PRIOR ART FIG. 4
FIG. 4 is a perspective view of the conventional clamp connected terminal assembly.
Figure 5:
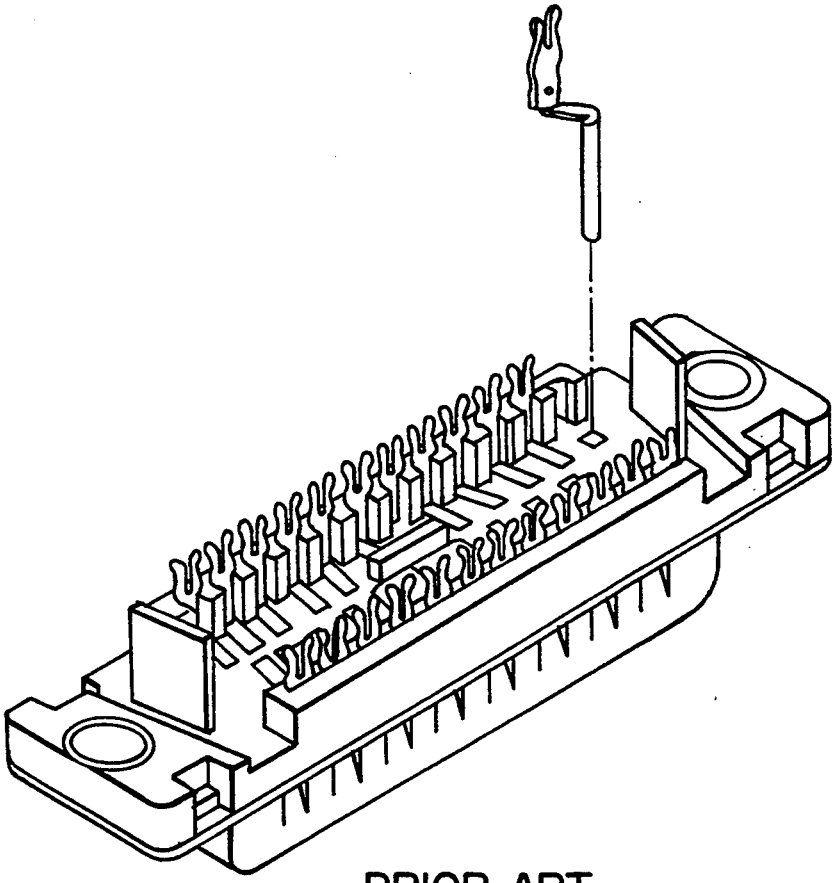
PRIOR ART FIG. 5
FIG. 5 is a perspective view of a conventional pressing connected terminal.
Figure 6:
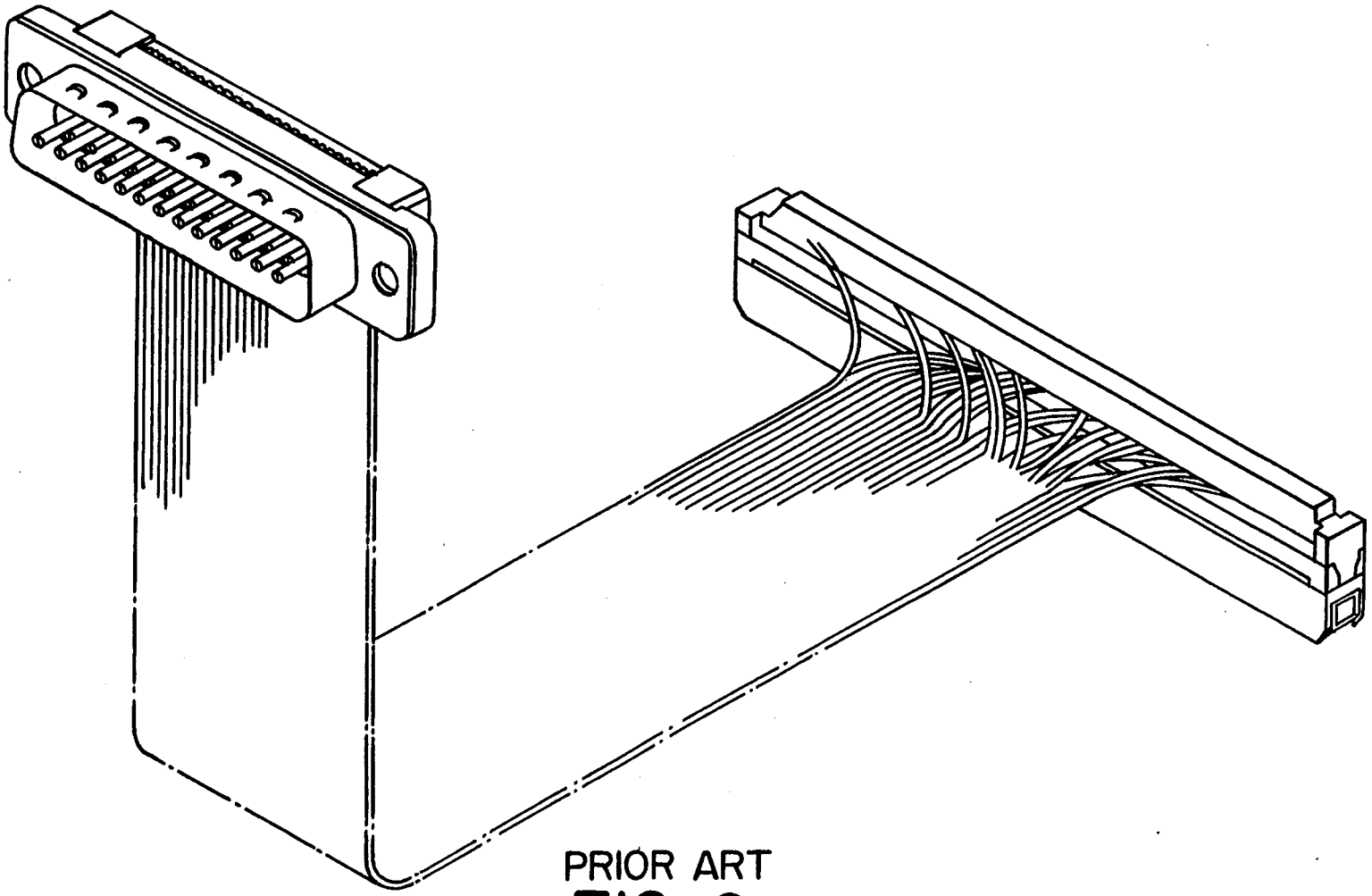
PRIOR ART FIG. 6
FIG. 6 is a perspective view of the conventional pressing connected terminal assembly.
Figure 7:
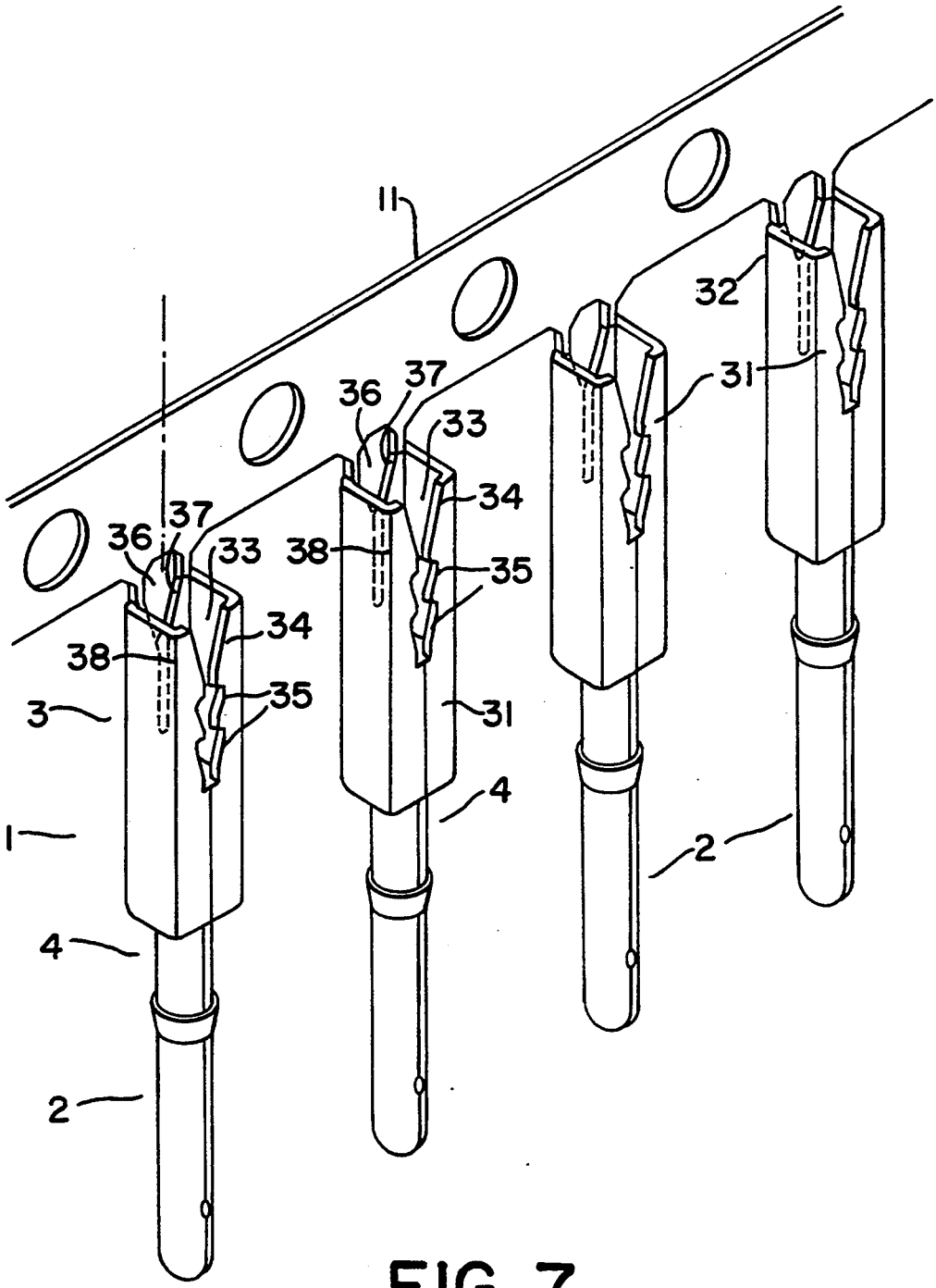
FIG. 7 is a perspective view of an embodiment of a male serial terminal of the present invention.

Referring first to FIG. 7, there is shown the perspective view of an embodiment of a male serial terminal of the present invention. The embodiment of the improved structure for connector terminals for use in computers directs primarily to the terminal structure for use in serial and parallel connectors. In the terminal 1 of the embodiment, a plate metal is stamped into a terminal array by stamping dies. When the terminal and the connector are being assembled, the side material is cut off and removed.

The terminal 1 is generally of a hollow elongated body, one end of the terminal 1 being a contacting section 2, the other end being a connecting section 3 with an inserting section 4 therebetween. The terminal 1 is inserted into a plastic base 6 of the connector and positively squeezed to be joined together by the inserting section 4. The contacting section 2 and the inserting section 4 of the terminal 1 are generally the same as those of the male terminal in conventional serial connectors which are not characteristic of the present invention and hence not described in any detail.

Figure 8:
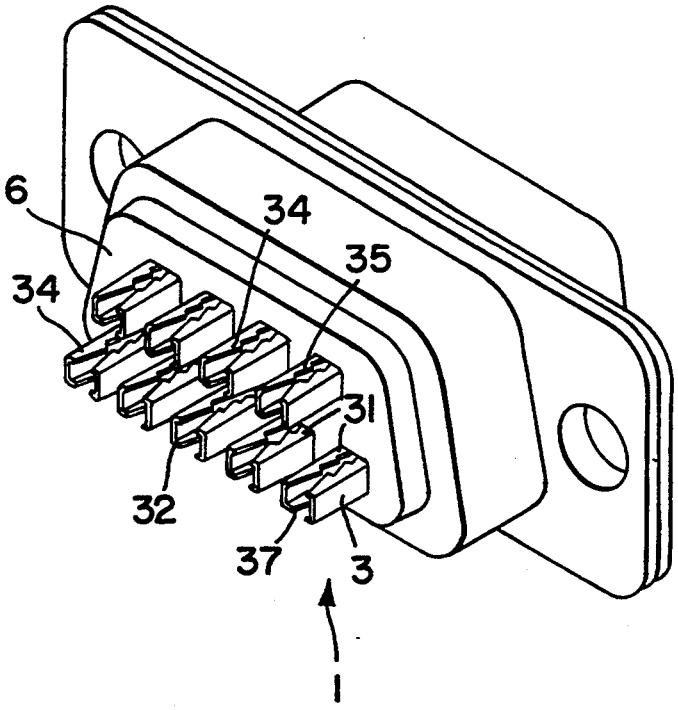
FIG. 8 is a perspective view of the embodiment of the male serial terminal assembly of the present invention.

Referring FIG. 8 there is shown the perspective view of the embodiment of a male serial terminal assembly of the present invention. The plastic base 6 of the connector is held by a front and a back metal casings (the front and back casings and the plastic base 6 are of conventional design). The terminal 1 is inserted into the plastic base 6, but the connecting section 3 of the terminal 1 is exposed. The connecting section 3 of the terminal 1 is generally of a hollow rectangular shape in cross section wherein a wall face 31 is formed into a downwardly extending axial groove 33 with the upper half of the axial groove 33 being formed with an angled opening 34 having a broad upper portion and a narrow lower portion. The narrow lower portion is slightly larger in dimension than the core 51 of lead 5. The lower half of the axial groove 33 is a flared catching notch 35. The axial groove 33 penetrates the thickness of the wall face 31.

The opposite wall face 32 of the connecting section 3 of the terminal 1 is formed into a downwardly extending axial slot 36, the upper half of the axial slot 36 being formed with an angled opening 37 having a broad upper portion and a narrow lower portion, and the lower half being an elongate slotted groove 38 having a width slightly smaller than the diameter of the core 51. The entire axial slot 36 penetrates the thickness of the wall face 32.

Figure 9B:
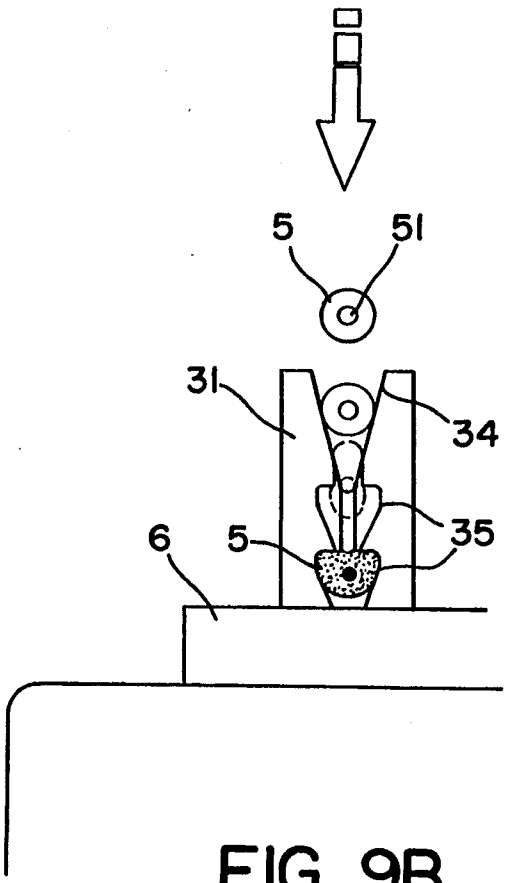
FIG. 9*a* and 9*b* are schematic views showing the leads being pressed into the terminal in the embodiment of the present invention.
Figure 9A:
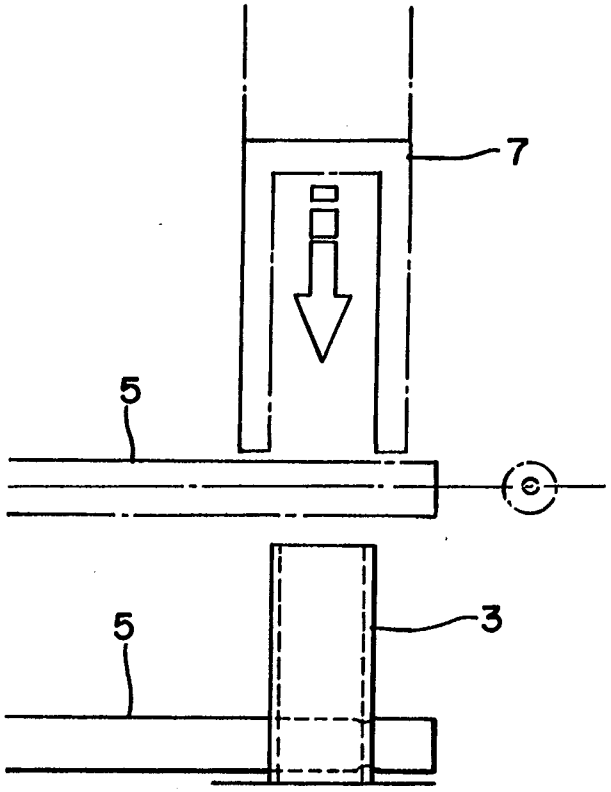

Referring to FIG. 9, there is shown the schematic view showing the leads being pressed into the terminal in the embodiment of the present invention. During connecting operation of the terminal 1 of the embodiment, the end of the lead 5 rides over the connecting section 3 of the terminal 1 and the lead 5 will straddle into the axial groove 33 and the angled opening 34 and the angled opening 37 of the axial slot 36, and then the lead 5 is pressed into the catching notch 35 and the elongate slotted groove 38 by the stamping dies.

Figure 10:
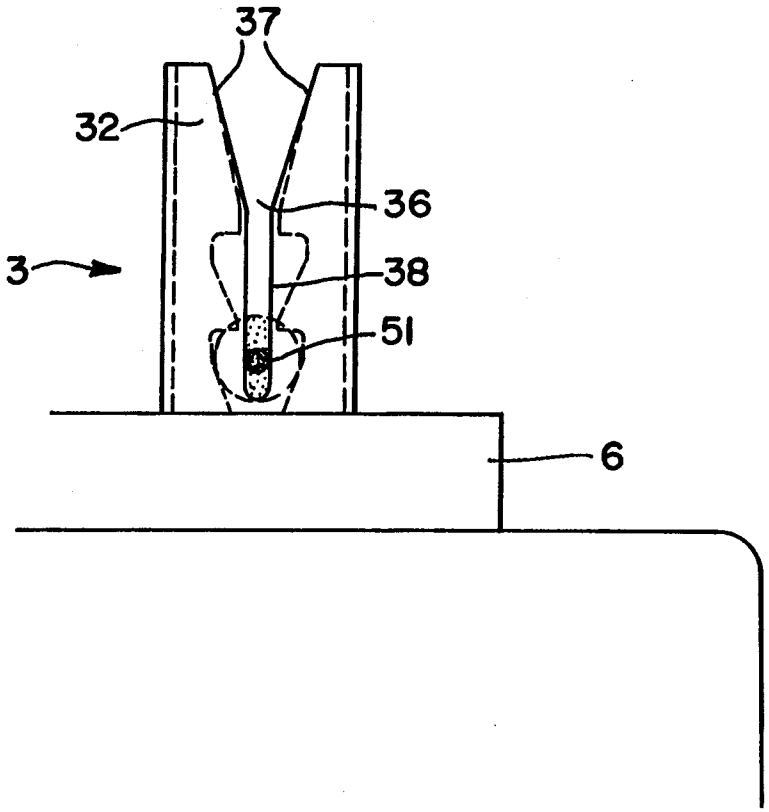
FIG. 10 is a schematic view showing the insulating layer being cut by the terminal cutting slot in the embodiment of the present invention.

Referring to FIG. 10, there is shown the schematic view showing the insulating layer being cut by the terminal cutting slot in the embodiment of the present invention. The elongate slotted groove 38 of the connecting section 3 of the terminal 1 in the embodiment has a width which is smaller than the diameter of the core 51 of the lead 5 such that when the lead 5 is pressed into the elongate slotted groove 38, the insulating layer of the lead 5 is easily cut by the edge of the elongate slotted groove 38 which further bites positively at the core 51 for direct contact.

Figure 11:
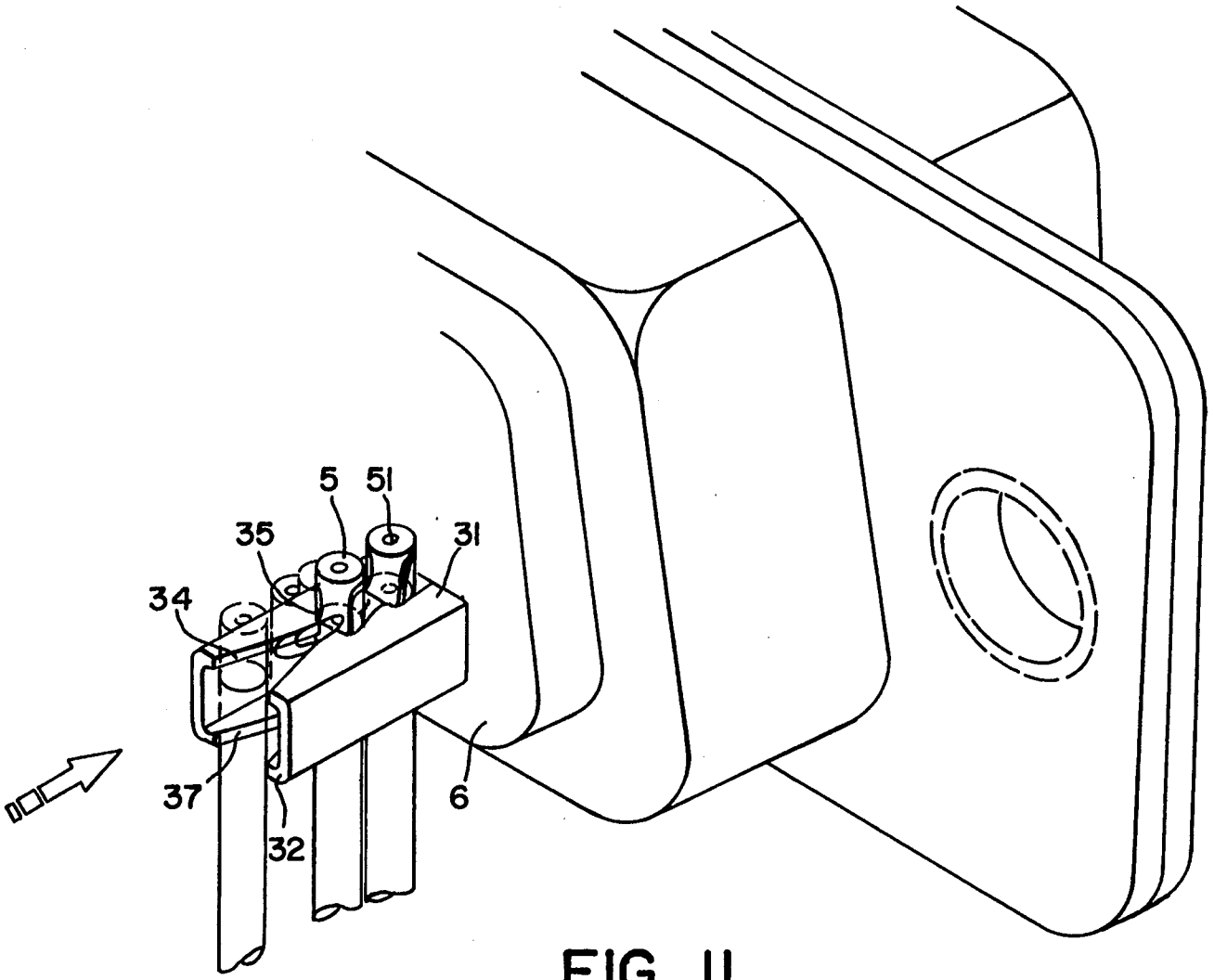
FIG. 11 is a schematic perspective view showing the leads being pressed into the terminal in the embodiment of the present invention.

Referring to FIG. 11, there is shown the schematic perspective view showing the leads being pressed into the terminal in the embodiment of the present invention. The axial groove 33 of the connecting section 3 of the terminal 1 in the embodiment can be designed to have an upper and lower catching notches 35, the catching notches 35 roughly resembling an inverted hollow triangle having a broad upper portion and a narrow lower portion, the narrow portion being larger in diameter than the core 51 and smaller than the insulating layer of the lead 5, but being divided at the middle into left and right halves by the axial groove 33 such that the angled opening 34 communicates with the upper and lower catching notches 35.

When the lead 5 is pressed into the angled opening 34 of the axial groove 33 by a press, the insulating layer of the lead 5 will deform due to plasticity and the axial groove 33 will be slightly stretched against the restoring force. The lead 5 can then be squeezed into each catching notch 35, step by step, or goes on to be squeezed into the catching notch 35 at the lowermost end. The lead 5 is then positively secured by the catching notch 35 and the elongate slotted groove 38 and will not easily come off.

Figure 12:
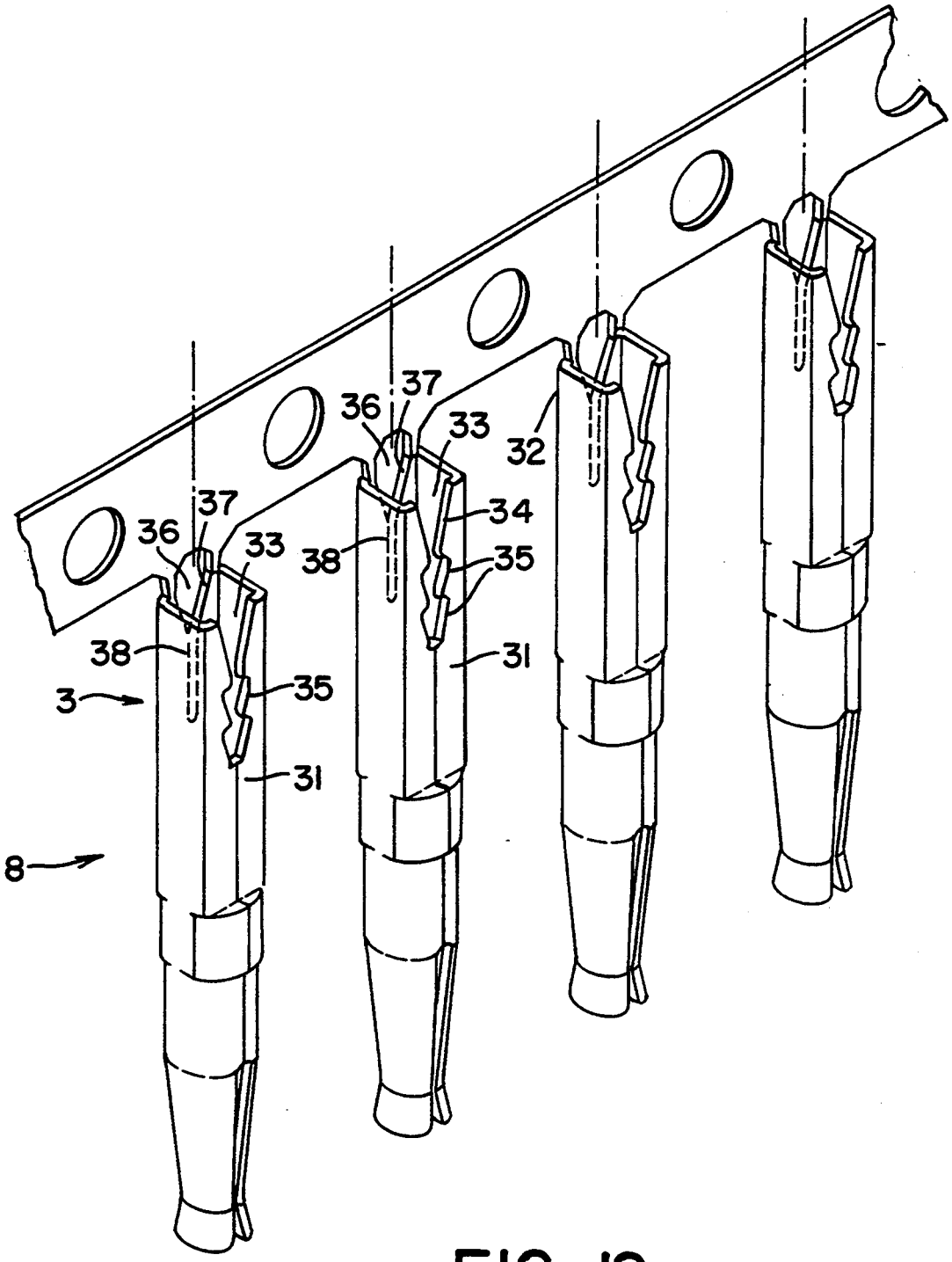
FIG. 12 is a perspective view of another embodiment of a female serial terminal of the present invention.

Referring to FIG. 12, there is shown the perspective view of another embodiment of a female serial terminal of the present invention. The terminal 8 is generally of a hollow elongate body, one end of the terminal 8 being a contacting section, the other end being a connecting section 3 with an inserting section therebetween. The contacting section and the inserting section of the terminal 8 are the same as those of the female terminal in conventional serial connectors which are not characteristic of the present invention and hence not described in any detail. The essential point of the terminal 8 resides in the connecting section 3, the connecting section 3 of the terminal 8 being the same as the connecting section 3 of the terminal 1.

Figure 13:
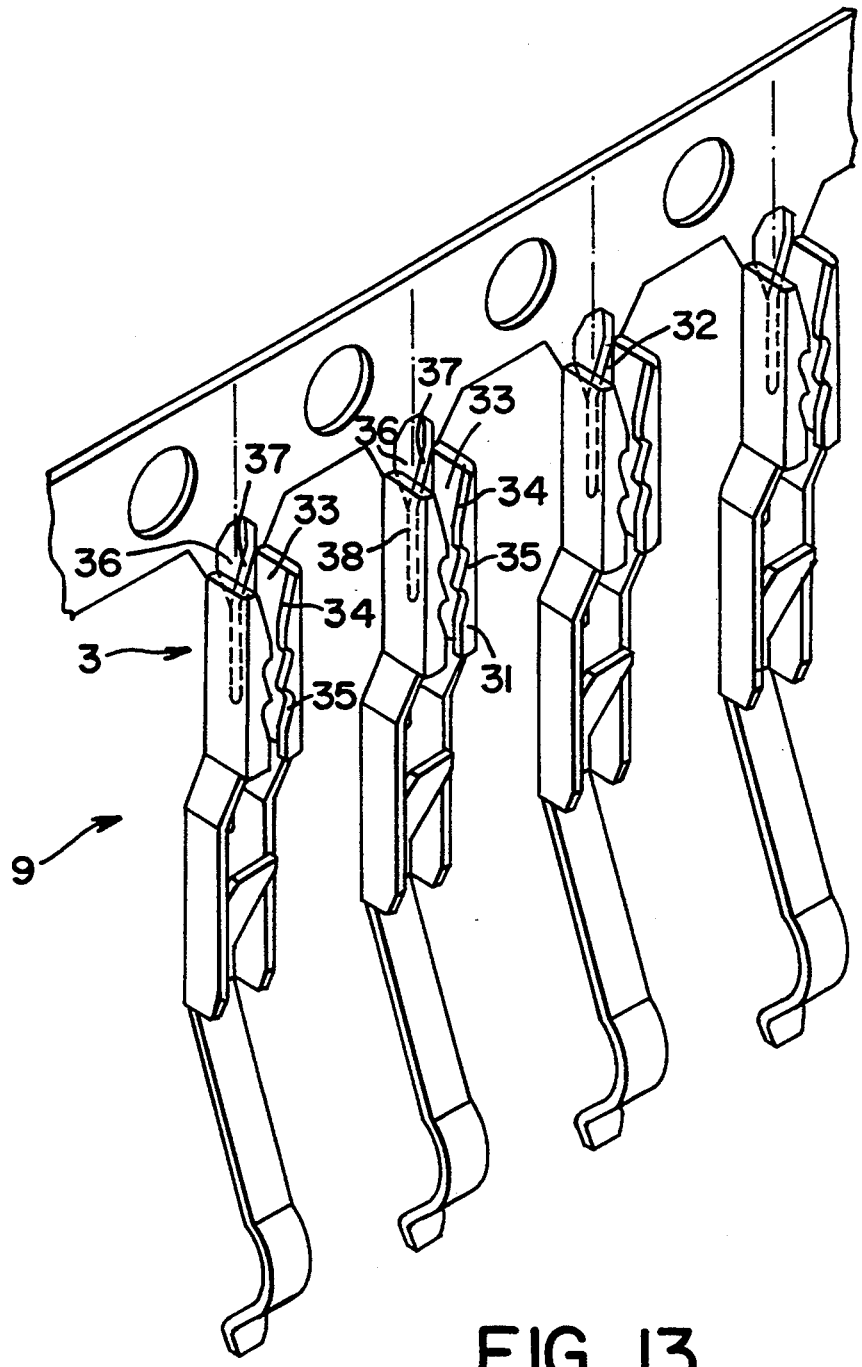
FIG. 13, is a perspective view of still another embodiment of a parallel terminal of the present invention.

Referring FIG. 13, there is shown the perspective view of still another embodiment of a parallel terminal of the present invention. The terminal 9 resembles essentially an elongate body, one end of the terminal 9 being a contacting section, the other end being a connecting section 3 with an inserting section therebetween. The connecting section and the inserting section of the terminal 9 are the same as those of the female terminal in conventional parallel connectors which are not characteristic of the present invention and hence not described in any detail. The essential point of the terminal 9 resides in the connecting section 3. In addition to that a parallel terminal 9 corresponding to another terminal 9 and hence they must be alternated for a half spacing, the connecting section 3 of the terminal 9 is the same as the connecting section 3 of the terminal 1.

In the embodiment, the lead 5 rides over the connecting section 3 of the terminal 1 and, at the same, is pressed into the axial groove 33 and the axial slot 36, causing the lead 5 to be squeezed into the catching notch 35, and the insulating layer of the lead 5 to be cut by the elongate slotted groove 38, the core 51 being thus made into direct contact with the terminal 1 and to become positively secured and not easy to come off, the overall assembly being simple and practical for use. With the terminal 1, in addition to one lead 5 for connection, it is also possible for one signal terminal 1 to be shared by two leads 5. Of course, a terminal 1 can be used for three leads 5, if it is designed to have three catching notches 35.

From the foregoing, in the improved structure for connector terminals for use in computers of the present invention, the welding hazards and impedance connection are avoided but instead a direct contact is utilized without using a plastic pressing strip. It is not necessary to clamp the leads one at a time. It will suffice to have only simple stamping dies and welding and clamping devices are not required to completely overcome the drawbacks with conventional welding, clamping and pressing types of terminals. Although the preferred embodiments have been described in detail, is should be understood that various modifications and changes can be made by those skilled in the art without departing from the spirit and scope of the present invention as defined in the appended claims.

I claim:

1. A computer connector terminal for receiving at least two leads, the terminal comprising:

a first and second end, the first end being a contacting section and the second end being a connecting section with an inserting section therebetween, the contacting, inserting and connecting sections being linearly arranged, the connecting section of the terminal comprising a hollow, essentially rectangular body having peripheral wall faces, wherein one wall face comprises a downwardly extending axial groove, and an opposite wall face comprises a downwardly extending, elongate, smooth, axial slot for cutting into the core of a lead pressed into the slot, the axial groove having a lower part formed with at least two upper and lower catching notches communicating with each other, wherein the catching notches have a shape of an inverted triangle having a broad upper portion and a narrow lower portion, such that when a first lead is pressed into the axial groove and the axial slot, the lead becomes secured in one catching notch and when a second lead is pressed into the groove and slot, it becomes secured in the other catching notch.

2. The terminal of claim 1 wherein the terminal is stamped from plate metal.

* * * * *